United States Patent [19]

Considine

[11] 4,363,552

[45] Dec. 14, 1982

[54] STATIC MIXER

[75] Inventor: Robert J. Considine, Clinton, Iowa

[73] Assignee: E. I. Du Pont de Nemours and Company, Wilmington, Del.

[21] Appl. No.: 243,645

[22] Filed: Mar. 18, 1981

[51] Int. Cl.[3] ..... B01F 5/06

[52] U.S. Cl. ..... 366/340

[58] Field of Search ..... 366/336, 337, 338, 339, 366/340; 137/896; 138/42, 111, 115

[56] References Cited

U.S. PATENT DOCUMENTS

| | | | |
|---|---|---|---|
| 2,243,592 | 5/1941 | Wolf | 138/42 X |
| 3,128,794 | 4/1964 | Boucher et al. | 366/340 X |
| 3,470,912 | 10/1969 | Bydal | 366/338 X |
| 3,470,913 | 10/1969 | Booy | 138/37 |
| 3,583,678 | 6/1971 | Harder | 366/340 |
| 3,860,217 | 1/1975 | Grout | 366/336 |

*Primary Examiner*—Philip R. Coe
*Assistant Examiner*—Frankie L. Stinson

[57] ABSTRACT

A fluid flow mixer for viscous materials in a transfer pipe where axial channels and peripheral channels extend from the entrance end of the mixer to the exit end of the mixer such that, at the exit end, the axial channels alternate with the peripheral channels around the mixer's longitudinal axis.

4 Claims, 6 Drawing Figures

STATIC MIXER

BACKGROUND OF THE INVENTION

The field of the subject invention is the mixing of viscous material in a transfer pipe so as to reduce nonuniformities in the physical properties of the materials resulting from a lack of turbulence in the viscous flow. Reducing temperature nonuniformities across a viscous flow profile is of particular importance.

Devices of the prior art have attempted to solve the problems of nonuniformities in the flow of viscous material with varying degrees of success, depending on the nonuniformity being remedied. For example, mixers have been designed to invert the locations of an inner concentric half and an outer concentric half such that the inner becomes the outer and vice versa. Such a mixer is used to remedy a situation where, due to velocity gradients from axis to periphery, polymer material in the outer concentric half of a transfer pipe has remained in the transfer pipe longer than the polymer in the inner concentric half of the transfer pipe. In polymerization reactions such a situation allows the polymer in the outer concentric half of the transfer pipe to polymerize to a much higher molecular weight than the material in the inner concentric half. By inverting the locations of the two concentric halves at approximately midstream, the two halves spend equal time in the transfer pipe and are thus polymerized to equal molecular weights. This inversion, however, does not remedy any problems which may be caused by cross stream temperature variation. In that case such an inversion simply results in an inversion of the temperature profile of a cross section of the polymer flow.

Other mixers of the prior art simply divide flowing viscous material in a transfer pipe into a few layers and recombine these layers at the exit end of the mixer. For this layering to be effective in eliminating cross-section temperature variations, it would need to be repeated many times before cross-section temperature homogeneity could be achieved, thus requiring a number of mixers end to end in the transfer pipe.

SUMMARY OF THE INVENTION

The device of the subject invention is a fluid flow mixer for mixing viscous materials in a transfer pipe comprising a passageway with two open ends, an entrance end and an exit end, divided into at least two concentric portions, a peripheral concentric portion and an axial concentric portion. The peripheral concentric portion is further divided into at least two peripheral channels at the entrance end of the passageway and the axial concentric portion is further divided into at least two axial channels at the entrance end of the passageway. The channels extend from the entrance end to the exit end of the passageway such that, at the exit end, the peripheral and axial channels are alternately arranged around the longitudinal axis of the passageway. This alternating of peripheral and axial channels results in substantial cross section homogeneity of the viscous material as it flows out of the exit end of the passageway. The device is especially suited for alleviating cross section temperature variations, particularly where such variations are of the bulls-eye type, i.e., a temperature gradient exists from the periphery to the axis of a transfer pipe.

DETAILED DESCRIPTION OF THE PREFERRED EMBODIMENT

Figure 1:
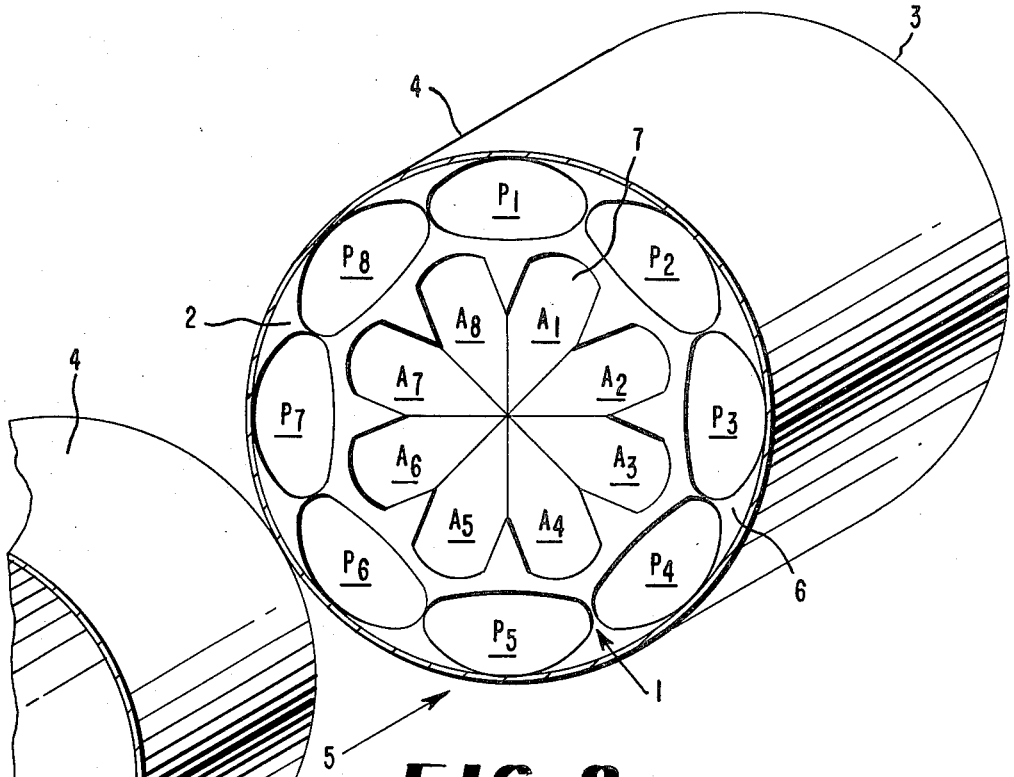
FIG. 1 is a perspective end view of an embodiment of the device of the subject invention located inside a transfer pipe.

In FIG. 1, the preferred embodiment of the device of the subject invention, mixer 1, is in place inside transfer pipe 4 through which viscous material flows in the direction of arrow 5, into entrance end 2, through mixer 1 and out exit end 3 of the mixer.

In FIG. 1, entrance end 2 of the device of the subject invention is divided into two concentric portions, axial concentric portion 7 and peripheral concentric portion 6. These concentric portions are further divided into axial channels $A_1$ through $A_8$ and peripheral channels $P_1$ through $P_8$. It may be desirable to divide entrance end 2 into more than two concentric portions and to divide the concentric portions into any number of channels. Such divisions, when arranged in accordance with the alternating rearrangement discussed below, results in cross section homogeneity of the flow of viscous material similar to that of the device as divided in FIG. 1. Eight channels are preferred. It has been found that if the axial and peripheral portions are divided into less than eight channels, the cross-section homogeneity will be compromised, and if the axial and peripheral portions are divided into more than eight channels, a greater pressure drop, as discussed below, over the length of the device, will be experienced.

Figure 2:
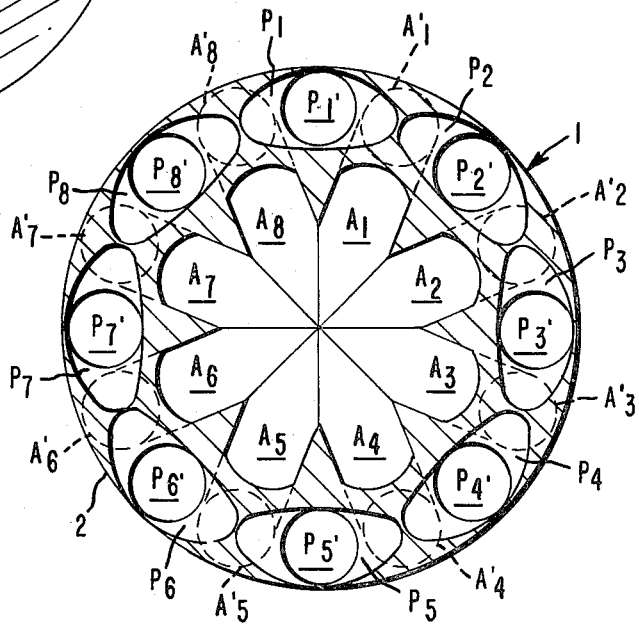
FIG. 2 is a cross section of an embodiment of the device of the subject invention.
Figure 3:
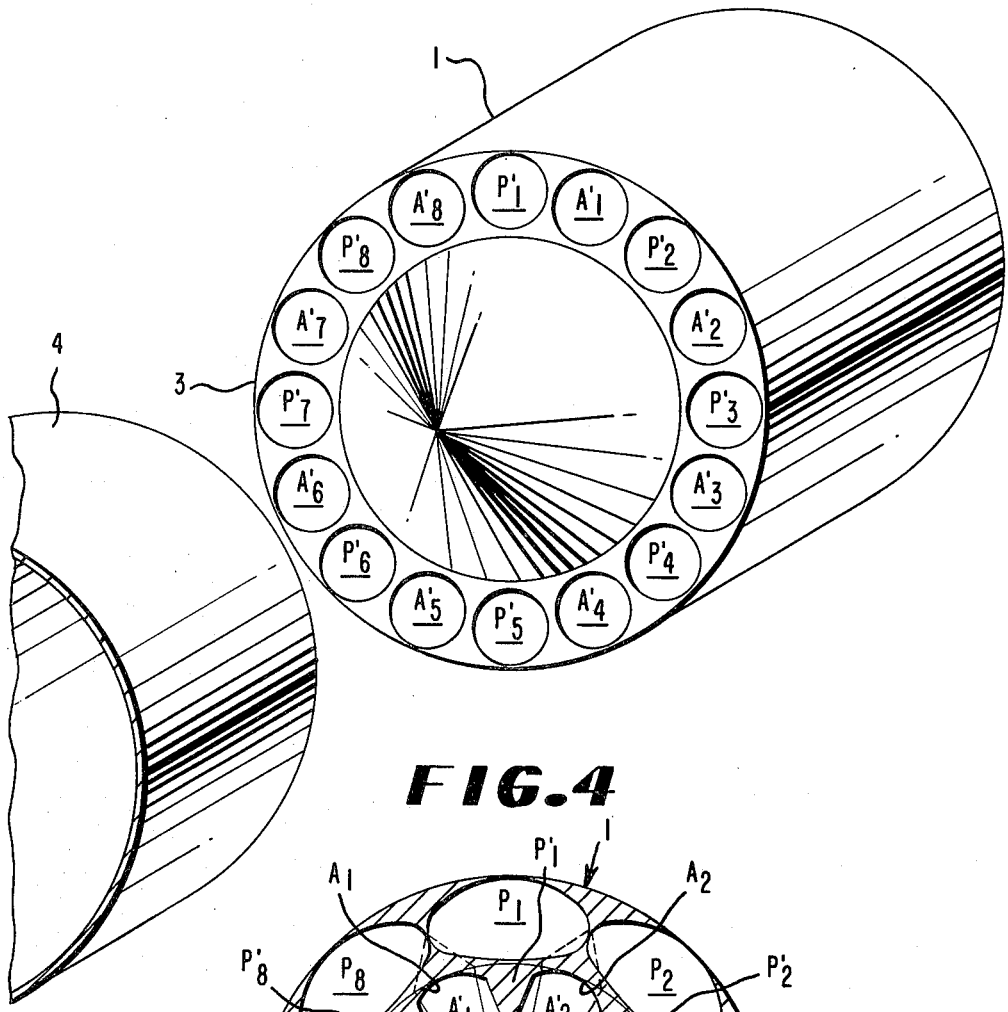
FIG. 3 is a perspective end view of an embodiment of the device of the subject invention.

In FIG. 2, viscous material flows into axial channels $A_1$ through $A_8$ and peripheral channels $P_1$ through $P_8$ at entrance end 2 of mixer 1. Axial channels $A_1$ through $A_8$ extend from the longitudinal axis of mixer 1 at the entrance end toward the wall of mixer 1 at the exit end such that axial channels $A_1$ through $A_8$, constructively transformed along mixer 1 into channels $A'_1$through $A'_8$, alternate with peripheral channels $P'_1$through $P'_8$, which have been constructively transformed along mixer 1 from peripheral channels $P_1$ through $P_8$. The end result, as seen in FIG. 3, is an alternating of channels $A'_1$through $A'_8$with channels $P'_1$through $P'_8$around the longitudinal axis of mixer 1 at exit end 3. Upon exiting from mixer 1, viscous material in channels $A'_1$through $A'_8$and $P'_1$through $P'_8$converge in transfer pipe 4 with substantial cross section homogeneity displayed by the viscous material. This convergence can be streamlined by attaching a conical extension to the exit end of the mixer.

Figure 4:
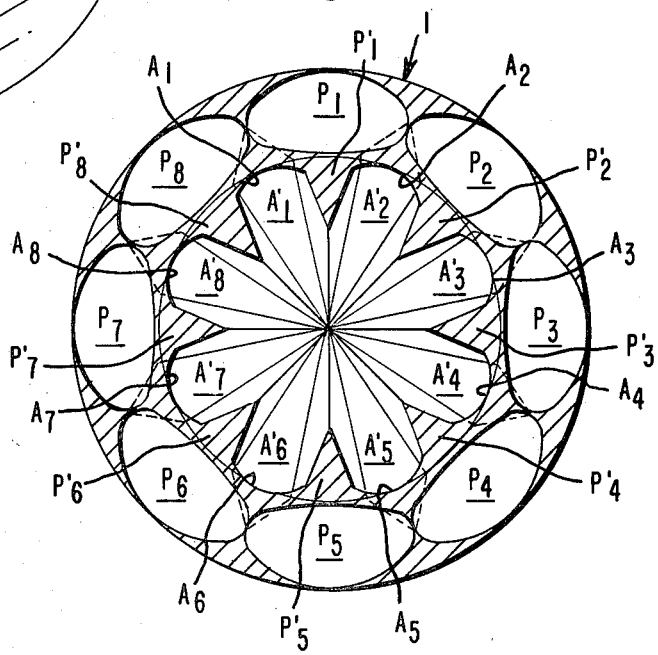
FIG. 4 is a cross section of an embodiment of the device of the subject invention.
Figure 5:
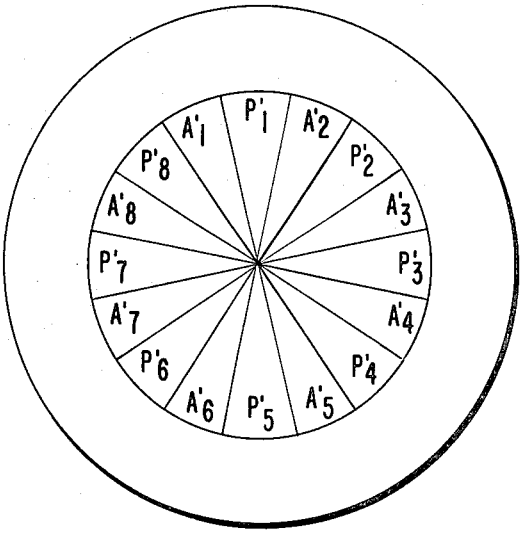
FIG. 5 is an end view of an embodiment of the device of the subject invention.

As seen in FIG. 4, the alternating of axial and peripheral channels around the longitudinal axis of mixer 1 can also be achieved by constructing mixer 1 with peripheral channels $P_1$ through $P_8$ extend from the wall of mixer 1 at entrance end 2 along the length of mixer 1 toward the longitudinal axis of mixer 1 such that peripheral channels $P_1$, through $P_8$ are constructively transformed into pie shaped $P'_1$ through $P'_8$. $A_1$ through $A_8$ are also constructively transformed into pie shaped $A'_1$through $A'_8$. The result at the exit end of mixer 1, seen in FIG. 5, is peripheral channels $P'_1$through $P'_8$alternating with axial channels $A'_1$through $A'_8$such that, upon exiting from mixer 1, viscous material displays substantial cross-section homogeneity.

It is recognized that when the device of the subject invention is of a size that can be inserted into a transfer pipe, such a device reduces the cross sectional area through which the viscous material is allowed to flow. The result of such reduction in cross sectional area is a pressure drop across the length of such a device as seen in the example that follows. Increasing the combined cross sectional area of the channels of the mixer reduces this pressure drop. However, such a device requires a diameter substantially larger than that of the transfer pipe. Therefore, if there is sufficient clearance surrounding the transfer pipe, and if use of a larger mixer is otherwise convenient, a section of the transfer pipe can be replaced by a mixer with channels having a greater combined cross sectional surface area to reduce the pressure drop over the length of the mixer. On the other hand, if the device of the subject invention is to be of a size for insertion into a transfer pipe, a small pressure drop over the length of the device is to be expected; the greater the number of channels, the greater the pressure drop.

EXAMPLE

Polypropylene copolymer having a viscosity of 17,748 poises, at 220° C., was run through a transfer pipe with a diameter of 5.7 cm and containing the preferred embodiment of the device of the subject invention, depicted in FIGS. 1–3, at a flow rate of 6 kg/min. Variable immersion thermocouples were inserted both upstream and downstream from the device at the center of the flow and at points 2.54 cm, 1.9 cm, 1.27 cm, and 0.635 cm from the wall of the transfer pipe. These temperatures were plotted, as seen in FIG. 6, to arrive at a cross section temperature profile of the polymer in the transfer pipe both upstream and downstream from the device of the subject invention.

Figure 6:
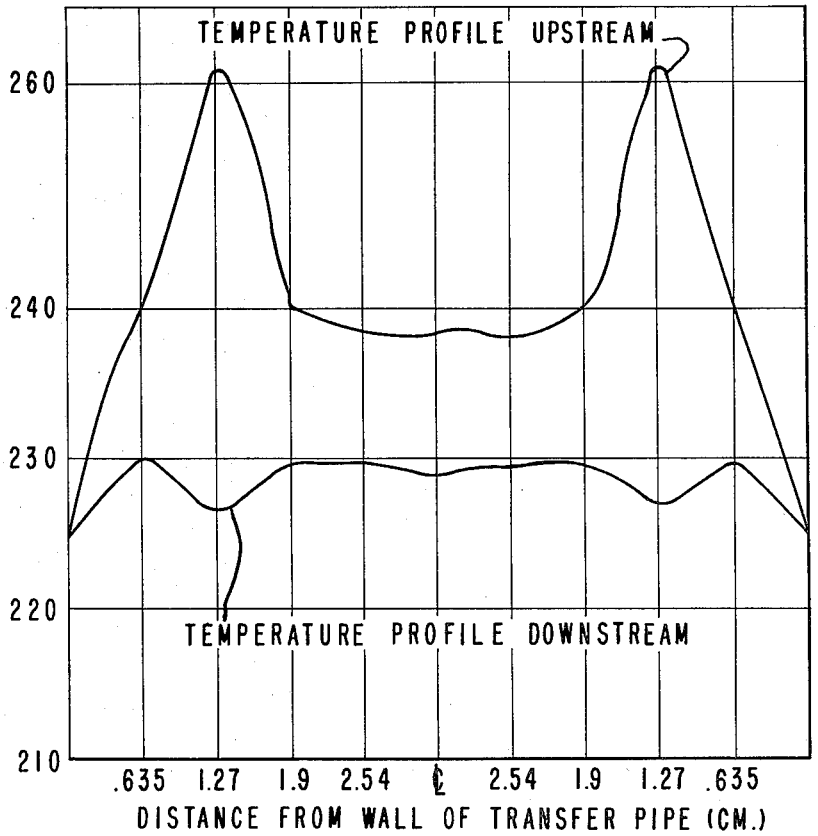
FIG. 6 is a graphic illustration of temperature profiles of viscous material both before and after flowing through the device of the subject invention.

These profiles, superimposed in FIG. 6, show that upstream from the device of the subject invention, a saddle-shaped profile existed, i.e., cross section temperature nonuniformity. In contrast, downstream from the device of the subject invention, substantial temperature cross section homogeneity was achieved.

The subject example exhibited a 160 psi pressure drop across the length of the device of the subject invention, approximately 5% of the 3,000 psi in the transfer pipe.

I claim:

1. An apparatus for mixing viscous materials in a transfer pipe comprising:

a passageway with two open ends, an entrance end and an exit end, divided into at least two concentric portions, a peripheral concentric portion and an axial concentric portion;

said peripheral concentric portion divided into at least two peripheral channels at the entrance of the passageway end and said axial concentric portion divided into at least two axial channels at the entrance end of the passageway;

said channels extending from the entrance end to the exit end such that, at the exit end, the peripheral and axial channels are arranged alternately around the longitudinal axis of said passageway;

whereby the alternating of peripheral and axial channels results in substantial cross-section homogeneity of the viscous material as it flows out of the exit end of the passageway.

2. The device of claim 1 wherein the axial channels extend from the longitudinal axis of the passageway at the entrance end toward the wall of the passageway at the exit end such that the axial channels alternate with the peripheral channels around the longitudinal axis of the passageway at the exit end of the passageway.

3. The device of claim 1 wherein the peripheral channels extend from the wall of the passageway at the entrance end toward the longitudinal axis of the passageway at the exit end such that the axial channels alternate with the peripheral channels around the longitudinal axis of the passageway at the exit end of the passageway.

4. The device of claims 2 or 3 wherein the axial concentric portion is divided into eight axial channels and the peripheral concentric portion is divided into eight peripheral channels.

* * * * *